US010155403B2

(12) United States Patent
Hatakeyama

(10) Patent No.: US 10,155,403 B2
(45) Date of Patent: Dec. 18, 2018

(54) CONVEYANCE SYSTEM

(71) Applicant: Brother Kogyo Kabushiki Kaisha, Nagoya-shi, Aichi-ken (JP)

(72) Inventor: Yuichi Hatakeyama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/812,832

(22) Filed: Nov. 14, 2017

(65) Prior Publication Data

US 2018/0281477 A1 Oct. 4, 2018

(30) Foreign Application Priority Data

Mar. 31, 2017 (JP) ..... 2017-071953

(51) Int. Cl.
*B41J 13/00* (2006.01)

(52) U.S. Cl.
CPC ..... *B41J 13/0009* (2013.01)

(58) Field of Classification Search
CPC ..... B41J 13/0009; B41J 11/42; B41J 11/44; B41J 13/02
See application file for complete search history.

(56) References Cited

U.S. PATENT DOCUMENTS 8,876,241 B2 * 11/2014 Iesaki ..... B41J 13/0009 347/16
9,382,084 B2 * 7/2016 Iesaki ..... B65H 5/06
9,958,820 B2 * 5/2018 Numazu ..... G03G 15/6529
2014/0291926 A1 10/2014 Iesaki
2014/0292874 A1 10/2014 Iesaki
2014/0295189 A1 10/2014 Hidaka et al.
2017/0087898 A1 3/2017 Iesaki

FOREIGN PATENT DOCUMENTS

JP 2010-198517 A 9/2010
JP 2014-196184 A 10/2014
JP 2014-197319 A 10/2014
JP 2016-005296 A 1/2016

* cited by examiner

*Primary Examiner* — Lamson Nguyen
(74) *Attorney, Agent, or Firm* — Banner & Witcoff, Ltd.

(57) ABSTRACT

A conveyance system includes a conveyance mechanism including two rollers, two drive devices, two measuring devices, and a controller. For a first period during which a sheet is conveyed with one of the two rollers, the controller calculates first and second control inputs U1 and U2 whereas for a second period during which the sheet is conveyed with the two rollers, the controller calculates the second control input U2, two estimated tension values R1 and R2, and the first control input U1=U2−UR. For an initial period of the second period, the controller adjusts the first control input U1 to restrain the first control input U1 from change.

11 Claims, 12 Drawing Sheets

CONVEYANCE SYSTEM

CROSS REFERENCE TO RELATED APPLICATION

The present application claims priority from Japanese Patent Application No. 2017-071953 filed on Mar. 31, 2017, the disclosures of which is incorporated herein by reference in its entirety.

BACKGROUND

Field of the Invention

The present disclosure relates to a system configured to convey a sheet by rotations of first and second rollers.

Description of the Related Art

Conventionally, there are known conveyance systems configured to convey a sheet by rotations of a plurality of rollers. Controlling the sheet conveyance is realized by controlling a motor for each roller. Such a conveyance system is mounted in, for example, an image forming system such as an ink jet printer or the like.

Due to a change in flexure of the sheet, deviation may occur in landing points of ink droplets, thereby decreasing the quality of images formed on the sheet. In order to restrain such decrease in the quality of images, there are known systems conveying the sheet while controlling a tension of the sheet.

SUMMARY

However, in a system conveying the sheet with the plurality of rollers while controlling the sheet tension, it is not possible at one time to control the tension when the sheet is conveyed with one of the plurality of rollers. Further, it is possible at another time to control the tension when the sheet is conveyed with another one of the plurality of rollers. When switching the control between such a period during which it is not possible to control the tension and such another period during which it is possible to control the tension, it is possible to increase control errors. For example, during the tension controllable period, when controlling the sheet tension to approach a target tension from zero, the rotation of the roller on the upstream side is restrained. On this occasion, it is possible for the sheet speed to deviate in the direction of decrease from a target speed.

Thereby, according to one aspect of the present disclosure, it is desirable to provide a technique capable of controlling the sheet tension while restraining movement of the sheet from deviating from a target in the initial period of the period when the sheet is conveyed with a plurality of rollers.

According to a first aspect of the present disclosure, there is provided a conveyance system configured to convey a sheet, including: a conveyance mechanism including a first roller and a second roller arranged apart from the first roller in a conveyance path for the sheet, the conveyance mechanism being configured to convey the sheet by the first roller and the second roller; a first driver configured to drive the first roller; a second driver configured to drive the second roller; a first measuring device configured to measure a state quantity related to a rotation of the first roller; a second measuring device configured to measure a state quantity related to a rotation of the second roller; and a controller configured to control the first driver by inputting a drive signal corresponding to a first control input U1 to the first driver, and control the second driver by inputting a drive signal corresponding to a second control input U2 to the second driver. In a first period during which the sheet is conveyed with one of the first roller and the second roller, the controller is configured to perform: calculating the first control input U1 based on the state quantity measured by the first measuring device, and a target state quantity; and calculating the second control input U2 based on the state quantity measured by the second measuring device, and the target state quantity. In a second period during which the sheet is conveyed with both of the first roller and the second roller, the controller is configured to perform: calculating the second control input U2 based on the state quantity measured by the second measuring device, and the target state quantity; calculating a first estimated tension value R1 which is an estimated value of a tension exerted on the first roller, based on the first control input U1 and the state quantity measured by the first measuring device; calculating a second estimated tension value R2 which is an estimated value of a tension exerted on the second roller, based on the second control input U2 and the state quantity measured by the second measuring device; calculating a tension control input UR which is a control input for controlling a tension of the sheet based on the first estimated tension value R1, the second estimated tension value R2, and a target tension Rr; calculating the first control input U1=U2−UR for conveying the sheet with the target tension by subtracting the tension control input UR from the second control input U2. In an initial period of the second period, the controller is configured to perform adjusting the first control input U1 to restrain the first control input U1 from change.

By the control in the first period as described above, at the transition from the first period to the second period, the first control input U1 and the second control input U2 approximate each other. On the other hand, in the initial period of the second period, because of attempting to control the sheet tension from proactively zero to the target tension Rr, a large tension control input is calculated and, thereby, if there is no any further measure, then the first control input U1 will change greatly. Due to this reason, the motion of the sheet will deviate from the target.

To address this problem, according to the first aspect of the present disclosure, in the initial period of the second period, the first control input U1 is adjusted to restrain the first control input U1 from change. Therefore, it is possible to control the sheet tension while restraining the sheet motion from deviating from the target. The state quantity and the target state quantity described above may be, respectively, a speed and a target speed. In such a case, it is possible to raise the sheet tension up to the target tension while restraining the sheet speed from deviating from the target speed.

According to a second aspect of the present disclosure, there is provided a conveyance system configured to convey a sheet, including: a conveyance mechanism including a first roller and a second roller arranged apart from the first roller in a conveyance path for the sheet, the conveyance mechanism being configured to convey the sheet by rotations of the first roller and the second roller; a first driver configured to drive the first roller; a second driver configured to drive the second roller; a first measuring device configured to measure a state quantity related to a rotation of the first roller; a second measuring device configured to measure a state quantity related to a rotation of the second roller; and a controller configured to control the first driver by inputting a drive signal corresponding to a first control input U1 to the first driver and control the second driver by inputting a drive signal corresponding to a second control input U2 to the second driver. In a first period during which the sheet is conveyed with one of the first roller and the second roller, the controller is configured to perform: calculating the first control input U1 based on the state quantity measured by the first measuring device, and a target state quantity, and calculating the second control input U2 based on the state quantity measured by the second measuring device, and the target state quantity. In a second period during which the sheet is conveyed with both of the first roller and the second roller, the controller is configured to perform: calculating the second control input U2 based on the state quantity measured by the second measuring device, and the target state quantity; calculating a first estimated tension value R1 which is an estimated value of a tension exerted on the first roller, based on the first control input U1 and the state quantity measured by the first measuring device; calculating a second estimated tension value R2 which is an estimated value of a tension exerted on the second roller, based on the second control input U2 and the state quantity measured by the second measuring device; calculating, with a function, a tension control input UR which is a control input for controlling a tension of the sheet based on the first estimated tension value R1, the second estimated tension value R2, and a target tension Rr; and calculating the first control input U1=U2−UR for conveying the sheet with the target tension by subtracting the tension control input UR from the second control input U2. The function includes a derivative element for restraining the tension control input UR from change in an initial period of the second period.

With the presence of the derivative element, it is possible to restrain the tension control input UR from change in the initial period of the second period. As a result, it is possible to restrain the first control input U1 from change in the initial period of the second period.

DESCRIPTION OF THE EMBODIMENT

Referring to the accompanying drawings, an exemplary embodiment of the present disclosure will be explained below.

Figure 1:
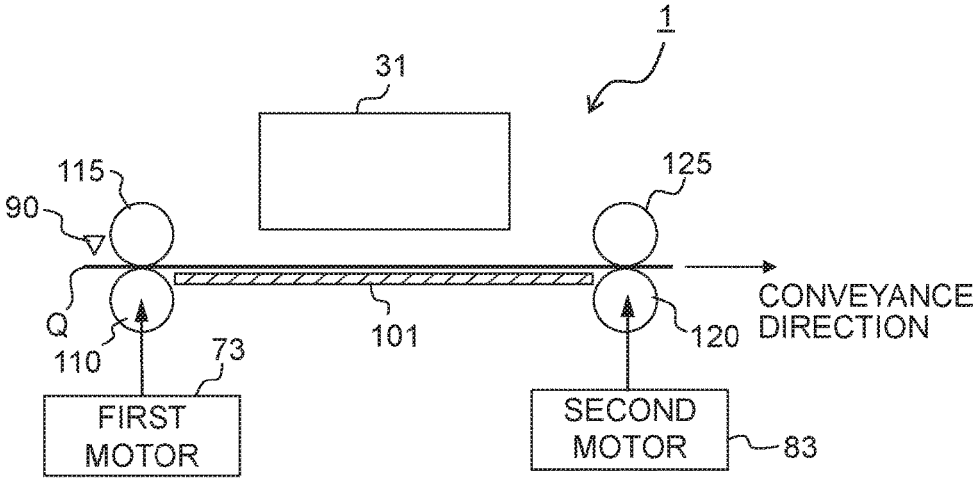
FIG. 1 is a diagram depicting a configuration of a periphery of a paper conveyance path in an image forming system according to an embodiment of the present invention.

An image forming system 1 of the embodiment is an ink jet printer. This image forming system 1 includes, as depicted in FIG. 1, an ink jet head 31 above a platen 101 constituting a conveyance path for paper Q. The ink jet head 31 includes a nozzle group on its lower surface to jet ink droplets toward the paper Q passing over the platen 101. This jet operation forms image on the paper Q.

The ink jet head 31 has such a shape as elongate in the line direction (the normal direction of FIG. 1), and is configured to be capable of forming the image simultaneously on the entire area of the paper Q, in the line direction, passing over the platen 101. The image forming system 1 jets the ink droplets from the elongate ink jet head 31 with the paper Q being conveyed at a constant speed in a conveyance direction depicted in FIG. 1. By virtue of this, the image is formed on the paper Q.

By the rotations of a first roller 110 and a second roller 120, the paper Q is conveyed downstream from the upstream of the conveyance path along the platen 101. The first roller 110 is provided on the upstream of the platen 101 and arranged to face a first driven roller 115. The second roller 120 is provided on the downstream of the platen 101 and arranged to face a second driven roller 125.

The first roller 110 rotates with the paper Q nipped between the first roller 110 and the opposed first driven roller 115. By virtue of this, the paper Q is conveyed downstream. The first roller 110 is rotatably driven by a first motor 73 constructed of a DC motor. The second roller 120 rotates with the paper Q nipped between the second roller 120 and the opposed second driven roller 125. By virtue of this, the paper Q is conveyed downstream. The second roller 120 is rotatably driven by a second motor 83 constructed of a DC motor.

That is, in the image forming system 1, the paper Q is supported at two separate points in the conveyance path, by the first roller 110 and the second roller 120 arranged apart from each other across the platen 101 along the conveyance path. In this state, the first motor 73 and the second motor 83 are rotatably driven. By virtue of this, the paper Q is conveyed downstream.

In the image forming system 1, from the stage before supplying the paper Q to the first roller 110, the first motor 73 and the second motor 83 are rotatably driven to rotate the first roller 110 and the second roller 120 at a constant speed. Then, with the first roller 110 and the second roller 120 rotating at the constant speed, the paper Q is supplied to the first roller 110 from the upstream of the first roller 110.

Figure 2:
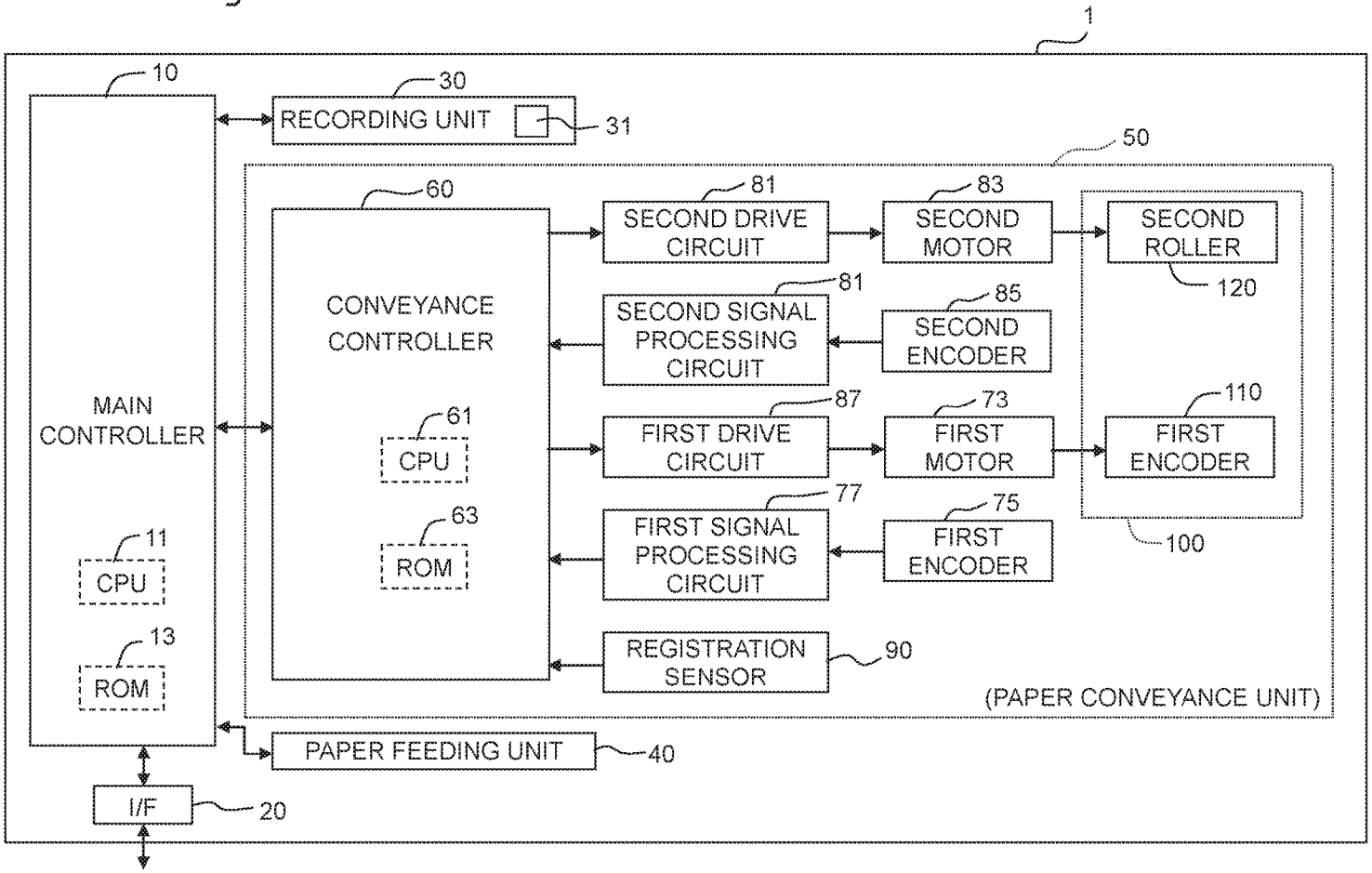
FIG. 2 is a block diagram depicting an overall configuration of the image forming system.

In particular, as depicted in FIG. 2, the image forming system 1 includes a main controller 10, a communication interface 20, a recording unit 30, a paper feeding unit 40, and a paper conveyance unit 50. A conveyance mechanism 100 for the paper Q includes the aforementioned first roller 110, first driven roller 115, second roller 120, second driven roller 125, and platen 101. The conveyance mechanism 100 for the paper Q is provided in the paper conveyance unit 50.

The main controller 10 includes a CPU 11 and a ROM 13 to overall control the image forming system 1. The overall control is realized by the CPU 11 carrying out processes subjected to programs recorded in the ROM 13. The communication interface 20 serves to realize communications between the main controller 10 and external devices. The main controller 10 receives a print command from an external device via the communication interface 20. On this occasion, the main controller 10 controls the recording unit 30, the paper feeding unit 40, and the paper conveyance unit 50 to form, on the paper Q, the image based on such an image data of a print object as received together with the print command.

The recording unit 30 includes the aforementioned ink jet head 31 and a drive circuit therefor (not depicted). The recording unit 30 drives the ink jet head 31 according to an instruction from the main controller 10 to form, on the paper Q, the image based on the image data of the print object.

The paper feeding unit 40 serves to supply the paper Q to the first roller 110, according to another instruction from the main controller 10. The paper feeding unit 40 includes a paper feeding roller and a paper feeding tray which are both not depicted.

The paper conveyance unit 50 includes, other than the aforementioned conveyance mechanism 100, a conveyance controller 60, a first drive circuit 71, a first motor 73, a first encoder 75, a first signal processing circuit 77, a second drive circuit 81, a second motor 83, a second encoder 85, a second signal processing circuit 87, and a registration sensor 90.

The first drive circuit 71 drives the first motor 73 at a drive current corresponding to a control input U10 inputted from the conveyance controller 60. The first drive circuit 71 is capable of PWM-driving the first motor 73. The first motor 73 is driven by the first drive circuit 71 to rotatably drive the first roller 110.

The first encoder 75 is a rotary encoder configured to output a pulse signal according to the rotation of the first roller 110. The first encoder 75 is provided in such a position as capable of directly or indirectly observing the rotational motion of the first roller 110. In the same manner as a well-known rotary encoder, the first encoder 75 outputs an A-phase signal and a B-phase signal different in phase as the pulse signal mentioned above. Hereinbelow, the A-phase signal and the B-phase signal will be expressed collectively as an encoder signal.

The encoder signal outputted from the first encoder 75 is inputted to the first signal processing circuit 77. Based on this encoder signal, the first signal processing circuit 77 measures a rotation amount X1 and a rotation speed V1 of the first roller 110, and inputs the measured information of the rotation amount X1 and rotation speed V1 to the conveyance controller 60.

The second drive circuit 81 drives the second motor 83 at a drive current corresponding to a control input U20 inputted from the conveyance controller 60. The second drive circuit 81 is capable of PWM-driving the second motor 83. The second motor 83 is driven by the second drive circuit 81 to rotatably drive the second roller 120.

The second encoder 85 is a rotary encoder configured to output an encoder signal according to the rotation of the second roller 120. The second encoder 85 is provided in such a position as capable of directly or indirectly observing the rotational motion of the second roller 120.

The encoder signal outputted from the second encoder 85 is inputted to the second signal processing circuit 87. Based on this encoder signal, the second signal processing circuit 87 measures a rotation amount X2 and a rotation speed V2 of the second roller 120, and inputs the measured information of the rotation amount X2 and rotation speed V2 to the conveyance controller 60.

The registration sensor 90 detects the passage of the paper Q. As depicted in FIG. 1, the registration sensor 90 is provided in the upstream of the first roller 110 to input, to the conveyance controller 60, a signal indicating that the paper Q has passed that point.

The conveyance controller 60 controls the first motor 73 and the second motor 83 based on the inputted signals from the first signal processing circuit 77, the second signal processing circuit 87 and the registration sensor 90. The conveyance controller 60 may either be configured as a dedicated circuit such as an ASIC or be constructed of a microcomputer. In the latter case, the conveyance controller 60 includes a CPU 61 and a ROM 63, as depicted in FIG. 2, to realize the control of the first motor 73 and the second motor 83 by the CPU 61 carrying out processes subjected to programs recorded in the ROM 63.

In particular, the conveyance controller 60 calculates the control input U10 for the first motor 73 and the control input U20 for the second motor 83 so as to convey the paper Q at the constant speed. When the paper Q is conveyed while receiving forces from both the first roller 110 and the second roller 120, the control input U10 and the control input U20 are calculated so as to convey the paper Q having a tension at the constant speed. The conveyance controller 60 inputs those control inputs U10 and U20 to the corresponding first drive circuit 71 and second drive circuit 81. By virtue of this, the conveyance controller 60 controls the rotations of the first motor 73 and second motor 83, as well as the conveyance of the paper Q.

In addition, if the motor control is supposedly carried out without considering the tension, then there is a possibility for the paper Q to bend on the platen 101 due to some control error. Such bending will exert adverse effect on the quality of the image formed on the paper Q. Therefore, as described above, the motor control is carried out considering the tension, but not a motor control without considering the tension. Due to such a reason, the conveyance controller 60 controls the first motor 73 and the second motor 83 so as to control both the speed and the tension of the paper Q.

Figure 3:
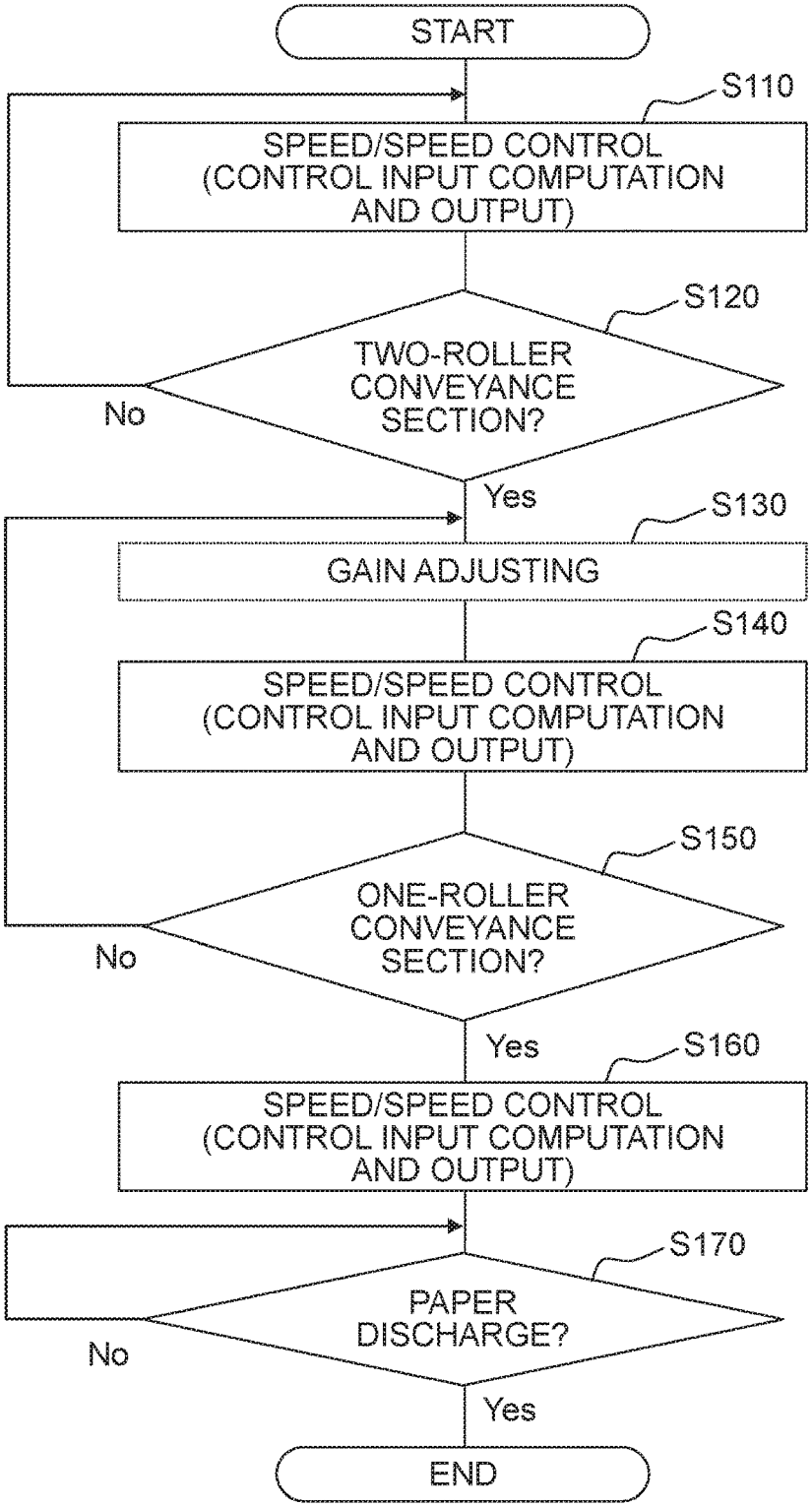
FIG. 3 is a flowchart of a conveyance control process carried out by a conveyance controller.

Following the instruction from the main controller 10, the conveyance controller 60 carries out the conveyance control process depicted in FIG. 3. By virtue of this, a paper conveyance is realized considering the speed and tension. After the conveyance control process is started, during the period before the anterior end of the paper Q reaches the second roller 120, the conveyance controller 60 repeatedly carries out a speed/speed control (S110) according to a controller 200 depicted in FIG. 4, with a predetermined control period. That is, during the period before the paper Q comes into the state of being nipped and conveyed by both the first roller 110 and the second roller 120, the conveyance controller 60 repeatedly carries out the speed/speed control (S110) according to the controller 200 depicted in FIG. 4, with the predetermined control period.

The next procedure can be used to determine that the anterior end of the paper Q has reached the second roller 120. That is, it is possible to determine that the anterior end of the paper Q has reached the second roller 120 from the difference between the latest rotation amount X1 and a rotation amount XG which is stored as the rotation amount X1=XG at the point of the registration sensor 90 detecting the anterior end of the paper Q.

In the step S110, the conveyance controller 60 can carry out the calculation of the control input U10 and control input U20 according to the controller 200, the input of the control input U10 to the first drive circuit 71, and the input of the control input U20 to the second drive circuit 81.

Figure 4:
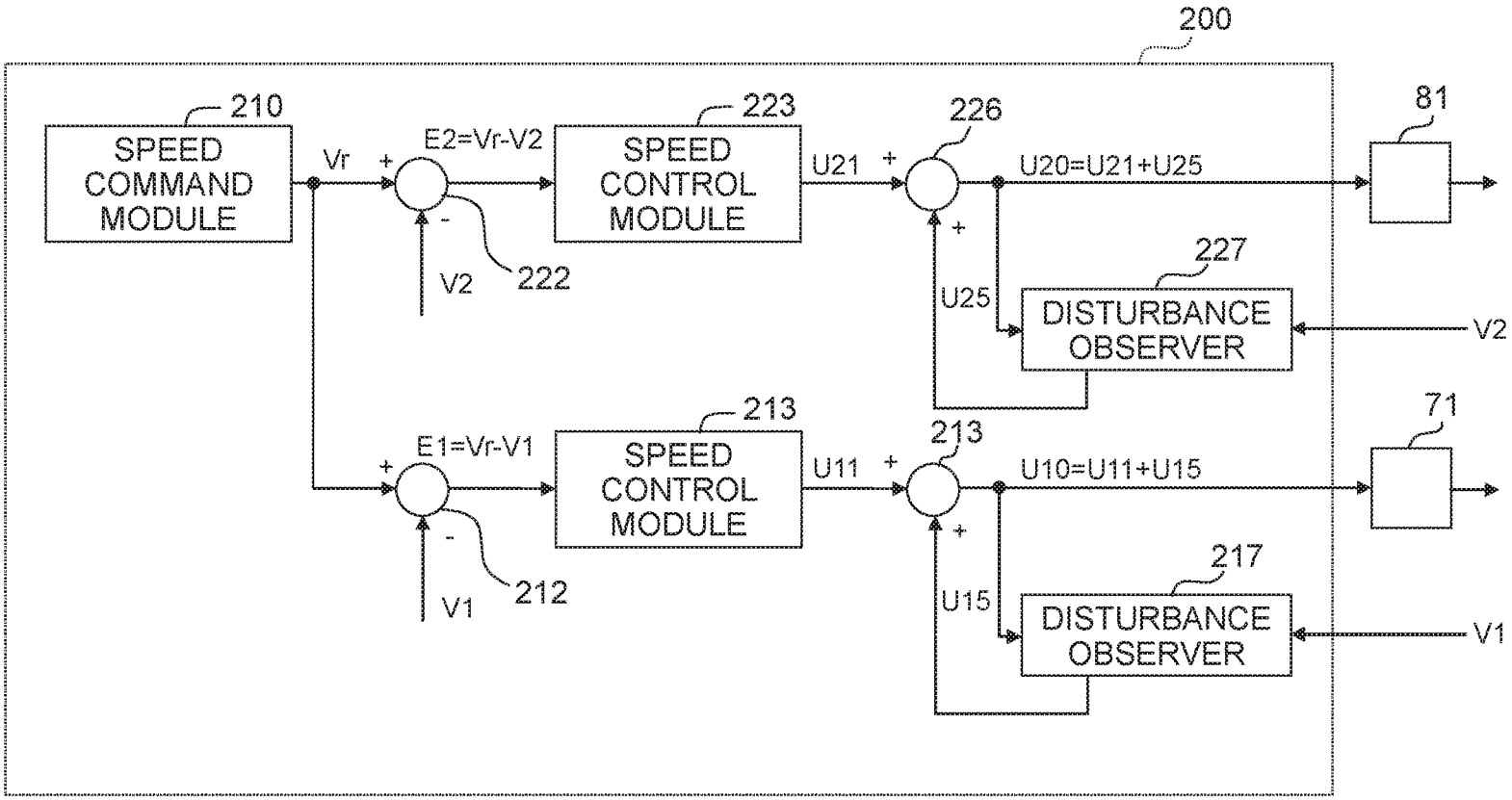
FIG. 4 is a block diagram depicting a configuration of a speed/speed controller.

As depicted in FIG. 4, the controller 200 includes a speed command module 210. Further, as the configuration for calculating the control input U10 for the first motor 73, the controller 200 includes a speed deviation calculator module 212, a speed control module 213, a first input control correction module 216, and a disturbance observer 217.

The speed command module 210 outputs a constant target speed as the target speed Vr for the paper Q. The speed deviation calculator module 212 calculates the deviation E1=Vr−V1 between the target speed Vr inputted from the speed command module 210, and the rotation speed V1 of the first roller 110 inputted from the first signal processing circuit 77. The speed control module 213 calculates a control input U11 corresponding to the deviation El as the control input for the first motor 73. The speed control module 213 is constructed of, for example, a proportioning control module. In this case, the speed control module 213 calculates the control input U11 in proportion to the deviation E1.

The first input control correction module 216 adds a compensation amount U15 from the disturbance observer 217 to the control input U11 from the speed control module 213, and calculates the control input U10=U11+U15. The first input control correction module 216 inputs the calculated control input U10 to the first drive circuit 71. The control input U10 corresponds to the control input for the first motor 73 after disturbance compensation. The disturbance observer 217 calculates the compensation amount U15 from the measured rotation speed V1 of the first roller 110, and the control input U10 inputted to the first motor 73.

As the configuration for calculating the control input U20 for the second motor 83, the controller 200 further includes a speed deviation calculation module 222, a speed control module 223, a second control input correction module 226, and a disturbance observer 227.

The speed deviation calculation module 222 calculates a deviation E2=Vr−V2 between the target speed Vr inputted from the speed command module 210, and the rotation speed V2 of the second roller 120 inputted from the second signal processing circuit 87. The speed control module 223 calculates a control input U21 corresponding to the deviation E2 as the control input for the second motor 83. The speed control module 223 is constructed of, for example, a proportioning control module. In this case, the speed control module 223 calculates the control input U21 in proportion to the deviation E2.

The second control input correction module 226 adds a compensation amount U25 from the disturbance observer 227 to the control input U21, and calculates the control input U20=U21+U25. The second control input correction module 226 inputs the calculated control input U20 to the second drive circuit 81. The disturbance observer 227 calculates the compensation amount U25 from the measured rotation speed V2 of the second roller 120, and the control input U20 inputted to the second motor 83.

That is, in the step S110, the conveyance controller 60 calculates the control input U10 for the first motor 73 based on the deviation between the rotation speed V1 and the target speed Vr of the first roller 110, and inputs the same to the first drive circuit 71; and calculates the control input U20 for the second motor 83 based on the deviation between the rotation speed V2 and the target speed Vr of the second roller 120, and inputs the same to the second drive circuit 81. By virtue of this, the first roller 110 and the second roller 120 are controlled such that the paper Q may be conveyed at the constant target speed Yr.

If the anterior end of the paper Q reaches the second roller 120 (S120: Yes), then the conveyance controller 60 adjusts the gain (S130) for the period before the posterior end of the paper Q leaves the first roller 110 while repeatedly carrying out the speed/tension control (S140) according to a controller 300 depicted in FIG. 5, with a predetermined control period. That is, if the anterior end of the paper Q reaches the second roller 120 (S120: Yes), then the conveyance controller 60 adjusts the gain (S130) for the period during which the paper Q is nipped and conveyed by both the first roller 110 and the second roller 120 while repeatedly carrying out the speed/tension control (S140) according to the controller 300 depicted in FIG. 5, with the predetermined control period.

The controller 300 has a configuration part of which is the same as the controller 200. It should be appreciated that among the components of the controller 300, those to which the same numerals are assigned as depicted in the controller 200 are identical to the components of the controller 200.

Figure 5:
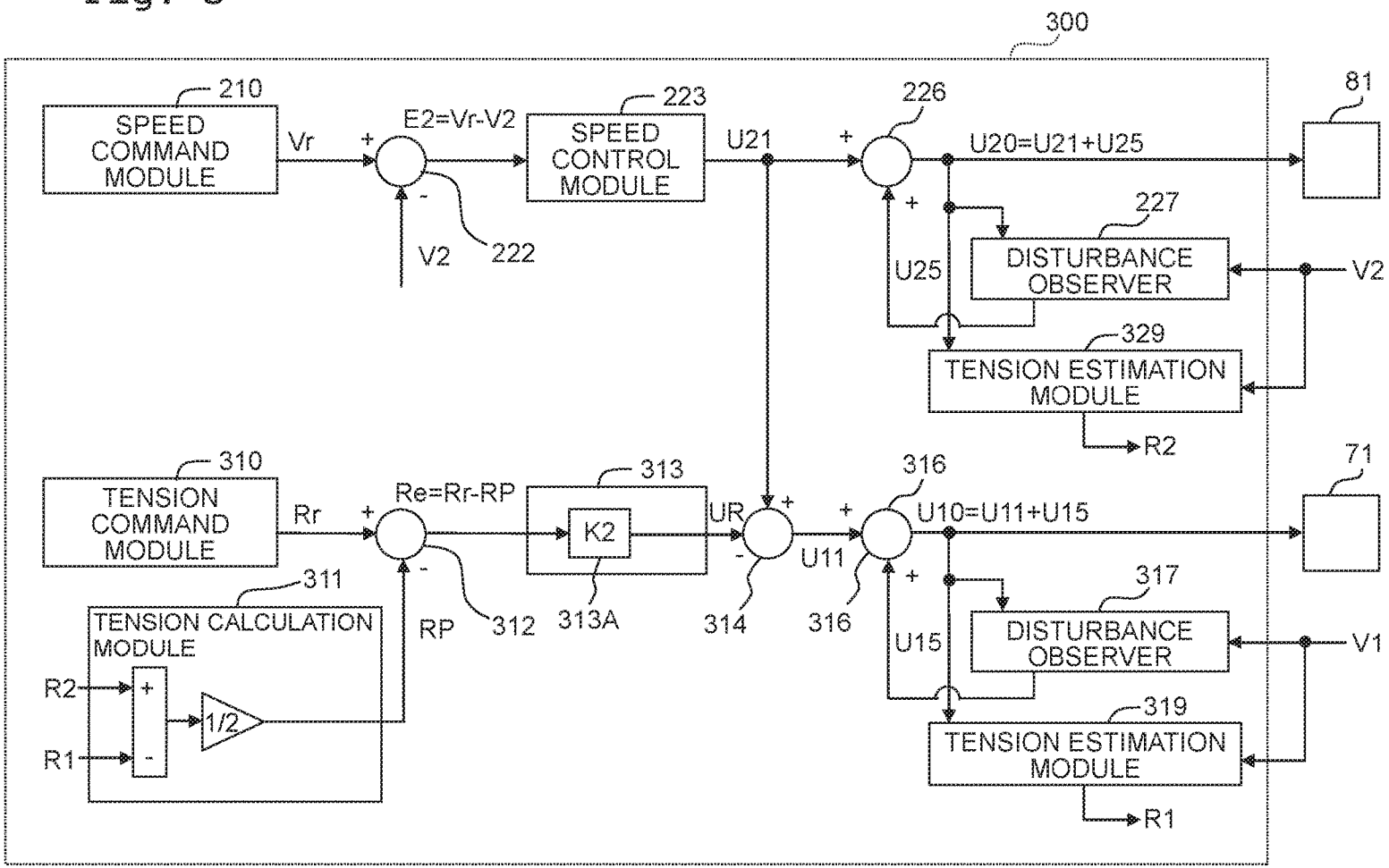
FIG. 5 is a block diagram depicting a configuration of a speed/tension controller.

The controller 300 depicted in FIG. 5 includes the speed command module 210. Further, as the configuration for calculating the control input U20 for the second motor 83, the controller 300 includes a speed deviation calculation module 222, a speed control module 223, a second control input correction module 226, and a disturbance observer 227.

In addition, as the configuration for calculating the control input U10 for the first motor 73, the controller 300 includes a tension command module 310, a tension calculation module 311, a tension deviation calculation module 312, a tension control module 313, a first control input calculation module 314, a reference control input entry module 315, a first control input correction module 316, and a disturbance observer 317.

The controller 300 further includes a first tension estimation module 319 and a second tension estimation module 329. As will be described later on in detail, the first tension estimation module 319 is configured to estimate the tension exerted on the first roller 110 from the paper Q, and output an estimated value R1 thereof. The second tension estimation module 329 is configured to estimate the tension exerted on the second roller 120 from the paper Q, and output an estimated value R2 thereof.

The tension command module 310 outputs a constant target tension as the target tension Rr for the paper Q. Based on the estimated values R1 and R2 from the first tension estimation module 319 and the second tension estimation module 329, the tension calculation module 311 calculates an estimated tension RP of the paper Q according to the formula RP=(R2−R1)/2.

The tension deviation calculation module 312 calculates the deviation Re=Rr−RP between the target tension Rr inputted from the tension command module 310 and the estimated tension RP for the paper Q inputted from the tension calculation module 311. Based on the deviation Re, the tension control module 313 calculates a tension control input UR which is a control input for controlling the tension for the paper Q to the target tension Rr. In particular, the tension control module 313 includes a proportional module 313A to calculate the tension control input UR=K2•Re in proportion to the deviation Re. The coefficient K2 is the gain of the proportional module 313A.

The first control input calculation module 314 calculates the control input U11=(U22−UR) by subtracting the tension control input UR from the control input U22=(K1•U21)

inputted from the reference control input entry module 315. The control input U11 corresponds to the control input for the first motor 73 for conveying the paper Q with the target tension Rr.

The reference control input entry module 315 inputs, to the first control input calculation module 314, the control input U22=(K1•U21) having exerted the gain K2 on the control input U21 from the speed control module 223. The gain K2 usually has the value "1", in which case the control input U22 corresponds to the control input U21 for the second motor 83.

The first control input correction module 316 calculates the control input U10=U11+U15 by adding the compensation amount U15 from the disturbance observer 317 to the control input U11, and inputs the calculated control input U10 to the first drive circuit 71.

The disturbance observer 317 calculates the compensation amount U15 for compensating the disturbance, from the measured rotation speed V1 of the first roller 110 and the control input U10 inputted to the first motor 73. By virtue of this, the first motor 73 is driven at the drive current according to the control input U10 after the disturbance compensation.

The first tension estimation module 319 calculates the estimated value R1 for the tension exerted on the first roller 110, based on the measured rotation speed V1 of the first roller 110 and the control input U10 inputted to the first motor 73.

Figure 6:
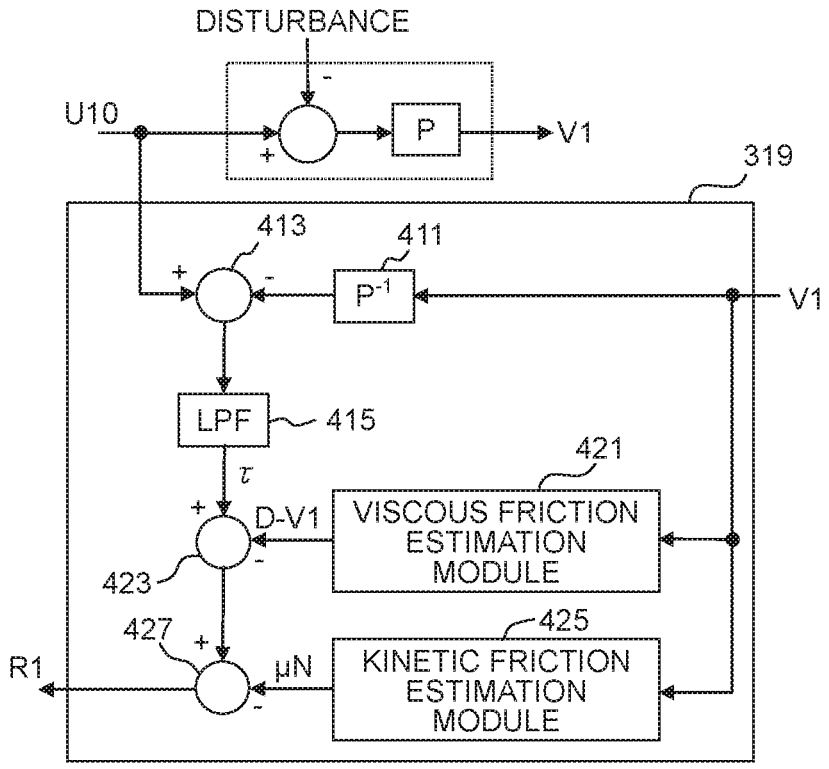
FIG. 6 is a block diagram depicting a configuration of a tension estimation module.

As depicted in FIG. 6, the first tension estimation module 319 includes an inverse model operation module 411, a subtractor 413, and a low-pass filter 415. The inverse model operation module 411 serves to convert the rotation speed V1 measured by the first signal processing circuit 77 into a corresponding control input U0 by using an inverse model $P^{-1}$ of a transfer function model P from the control input U10 to the rotation speed V1. The subtractor 413 calculates the deviation (U10−U0) between the control input U10 inputted to the first motor 73 and the control input U0 corresponding to the rotation speed V1 calculated by the inverse model operation module 411.

The low-pass filter 415 eliminates high-frequency contents from the deviation (U10−U0), and outputs the deviation (U10−U0) after the high-frequency contents are eliminated, as an estimated disturbance value τ. The deviation (U10−U0) is in amperes because the control input U10 is a current command value but, if the drive source is a DC motor, then a proportional relation holds between ampere and torque (reaction force). Therefore, the deviation (U10−U0) indirectly represents the force as a disturbance acting on a control object.

The estimated disturbance value τ includes not only the disturbance component caused by the tension but also a viscous friction component and a kinetic friction component arising from the rotation. Therefore, the first tension estimation module 319 calculates the estimated value R1 for the tension exerted on the first roller 110 by eliminating the viscous friction component and the kinetic friction component from the estimated disturbance value τ.

As the configuration for eliminating the viscous friction components from the estimated disturbance value τ, the first tension estimation module 319 further includes a viscous friction estimation module 421 and a subtractor 423. The viscous friction estimation module 421 outputs, as the estimated value of viscous friction force, the value (D•V1) of multiplying the rotation speed V1 measured by the first signal processing circuit 77 by a predetermined coefficient D. The subtractor 423 outputs an estimated disturbance value τ1=(τ−D•V1) after the viscous friction component is eliminated by subtracting the estimated value of viscous friction force from the estimated disturbance value τ.

In addition, as the configuration for eliminating the kinetic friction component from the estimated disturbance value τ, the first tension estimation module 319 includes a kinetic friction estimation module 425 and a subtractor 427. The kinetic friction estimation module 425 outputs a zero as the estimated value of kinetic friction force if the rotation speed V1 measured by the first signal processing circuit 77 is zero but outputs a predetermined nonzero value μN as the estimated value of kinetic friction force if the rotation speed V1 measured by the first signal processing circuit 77 is not zero. The subtractor 427 subtracts the estimated value of kinetic friction force from the estimated disturbance value τ1. The first tension estimation module 319 outputs the value calculated by the subtractor 427 as the estimated value R1 for the tension exerted on the first roller 110.

On the same principle, the second tension estimation module 329 calculates and outputs the estimated value R2 for the tension exerted on the second roller 120, based on the measured rotation speed V2 of the second roller 120, and the control input U20 inputted to the second motor 83.

In the step S140, the conveyance controller 60 calculates the control input U21 for the second motor 83 based on the deviation between the rotation speed V2 and the target speed Vr of the second roller 120 as described above, and inputs the control input U20 after the disturbance compensation to the second drive circuit 81.

Further, the conveyance controller 60 calculates the estimated value R1 for the tension exerted on the first roller 110 based on the control input U10 for the first motor 73 and the rotation speed V1 for the first roller 110, and calculates the estimated value R2 for the tension exerted on the second roller 120 based on the control input U20 for the second motor 83 and the rotation speed V2 of the second roller 120.

The conveyance controller 60 calculates the tension control input UR for controlling the tension of the paper Q to the target tension Rr, based on those estimated value R1, estimated value R2 and target tension Rr. Further, by subtracting the tension control input UR from the control input U22=K1•U21 having exerted the gain K1 on the control input U21 for the second motor 83, the conveyance controller 60 calculates the control input U11=U22−UR for conveying the paper Q with the target tension Rr, and inputs, to the first drive circuit 71, the control input U10 after the disturbance compensation, corresponding to the control input U11.

In this manner, during the speed/tension control period, the conveyance controller 60 calculates the control input U11 according to the formula U11=K1×U21−UR, based on the gain K1, the control input U21 and the tension control input UR. Then, the conveyance controller 60 inputs to the first drive circuit 71 the control input U10 having added the disturbance compensation to the control input U11 so as to drive the first motor 73. If K1=1, then the control input U11=U21−UR, such that the control input U11 for the first motor 73 is calculated as a control input which is smaller than the control input U21 for the second motor 83 by the tension control input UR. By virtue of this, the paper conveyance is realized with the tension corresponding to the target tension Rr.

Further, by adjusting the gain K1 in the step S130, the conveyance controller 60 adjusts the control input U11 to restrain the control input U11 from change during a certain period of time immediately after the anterior end of the paper Q reaches the second roller 120.

Immediately before a switch point Tw from the speed/speed control to the speed/tension control, the control input U11 and the control input U21 show almost the same value. Therefore, immediately after the switch point Tw, if the control input U11 is calculated according to the formula U11=U21−UR, then the control input U11 will decrease abruptly. Hence, a force in the reverse direction from the first roller 110 is exerted intensively on the paper Q conveyed by the rotating second roller 120. Thereby, a tension arises in the paper Q and, on the other hand, an excessive force acts to cause the rotation speed V2 for the paper Q to decrease from the target speed Yr.

Figure 7:
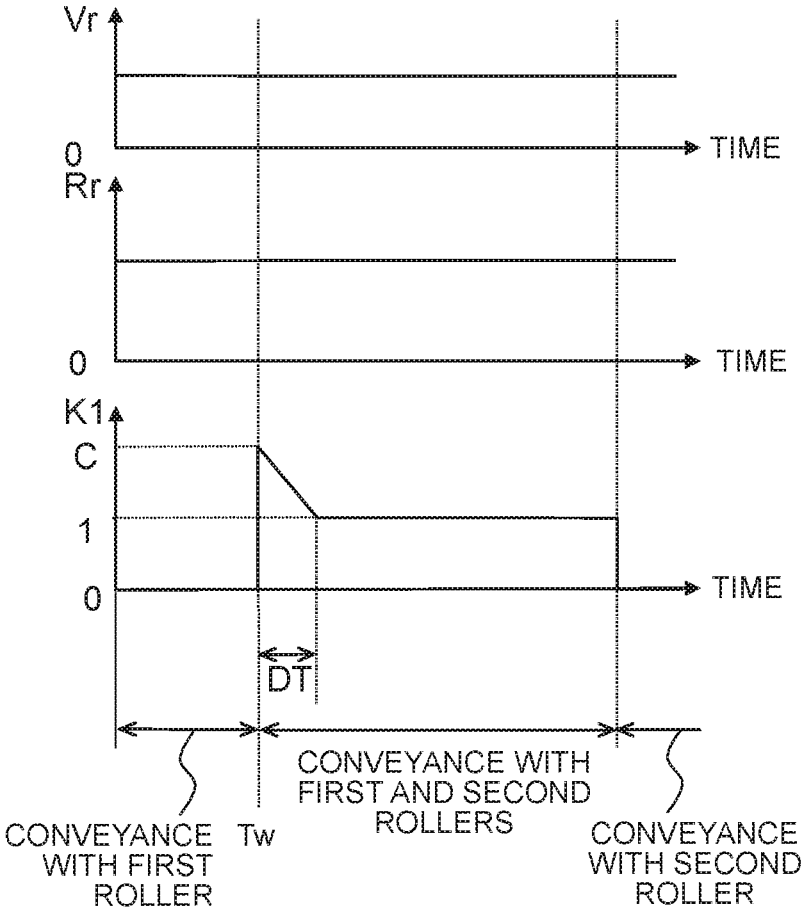
FIG. 7 is a graph depicting a gain adjustment aspect with a target speed and a target tension.

In this manner, in order to restrain the rotation speed V2 from deviating from the target speed Vr, as depicted in FIG. 7 in this embodiment, the gain K1 of the reference control input entry device 315 is set at the initial value C(C>1) for the initial period of carrying out the speed/tension control, i.e., during the period from the switch point Tw from the speed/speed control to the speed/tension control, until a predetermined time DT has passed. Then, by gradually adjusting the gain K1 to decrease from the initial value C to the value 1, the target tension Rr is realized while the control input U11 is adjusted to restrain the control input U11 from change.

In particular, in the step S130 carried out in each control period, the conveyance controller 60 adjusts, as depicted in FIG. 7, the gain K1 to monotonically decrease from the initial value C larger than the value 1 to the value 1 over the predetermined time DT. Thereafter, the conveyance controller 60 operates to maintain the gain K1 at the value 1 until the speed/tension control is ended. Hereinbelow, the predetermined time DT will also be referred to as adjustment time DT. The predetermined time DT is predetermined in the design stage, taking into consideration the subservience of the estimated tension to the target tension value, and the allowable speed decrease.

If the posterior end of the paper Q moves past the first roller 110 (S150: Yes), then the conveyance controller 60 repeatedly carries out the speed/speed control (S160) according to the controller 200 depicted in FIG. 4, with the predetermined period for the period before the posterior end of the paper Q leaves the second roller 120, that is, the period before the paper Q is discharged to a paper discharge tray. On finishing the discharge of the paper Q (S170: Yes), the conveyance controller 60 ends the process depicted in FIG. 3.

According to the image forming system 1 of the embodiment explained above, by adjusting the gain K1, it is possible to restrain the accuracy of the speed control of the paper conveyance from temporary decrease along with the switching from the speed/speed control to the speed/tension control. That is, immediately after the switching to the speed/tension control, it is possible to restrain the control input U11 for the first motor 73 from excessive decrease for realizing the target tension Rr. Hence, it is possible to restrain the paper speed from deviating from the target speed due to the excessive decrease of the control input U11.

Figure 8:
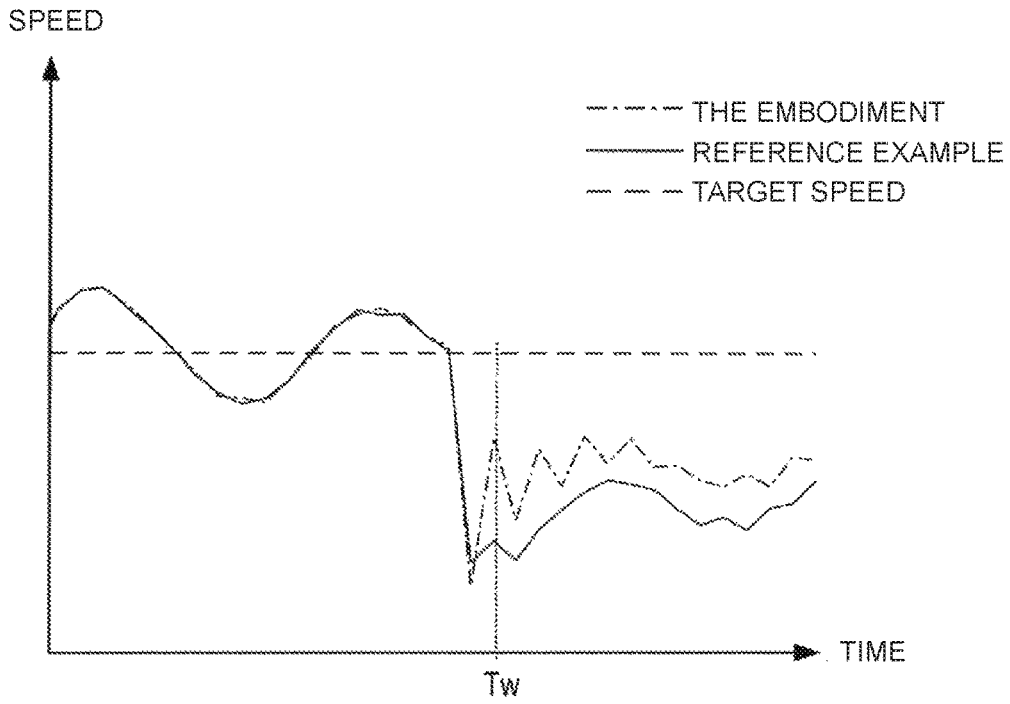
FIG. 8 is a graph explaining an improvement in speed variation.

FIG. 8 shows that the technique of the embodiment restrains the paper speed from deviating from the target speed Yr. With a graph on time versus speed, FIG. 8 shows the target speed Vr, a trajectory of the rotation speed V2 realized by the embodiment, and a trajectory of the rotation speed V2 if the gain K1 is supposedly not adjusted but kept at the value 1 in the embodiment (a reference example).

In this manner, according to the embodiment, with a conveyance system for the paper Q whose speed and tension is controlled, it is possible to restrain the speed from decreasing while increasing the paper tension up to the target tension Rr at the time of control switching along with the transition from the conveyance stage with a single roller to the conveyance stage with two rollers. Therefore, it is possible to form good-quality image on the paper Q by jetting ink droplets from the ink jet head 31.

Next, modifications of the image forming system 1 of the above embodiment will be explained. It should be appreciated that the image forming system 1 of the modifications is configured in the same manner as the image forming system 1 of the above embodiment except for those configurations and operations which will be explained below.

[First Modification]

The image forming system 1 according to a first modification is configured to change at least one of the initial value C and the adjustment time DT according to the type of the paper Q to be conveyed. On receiving a print command, the main controller 10 carries out a process depicted in FIG. 9 based on paper type information included in the print command. This process is, in particular, carried out by the CPU 11 subjected to a program stored in the ROM 13.

Figure 9:
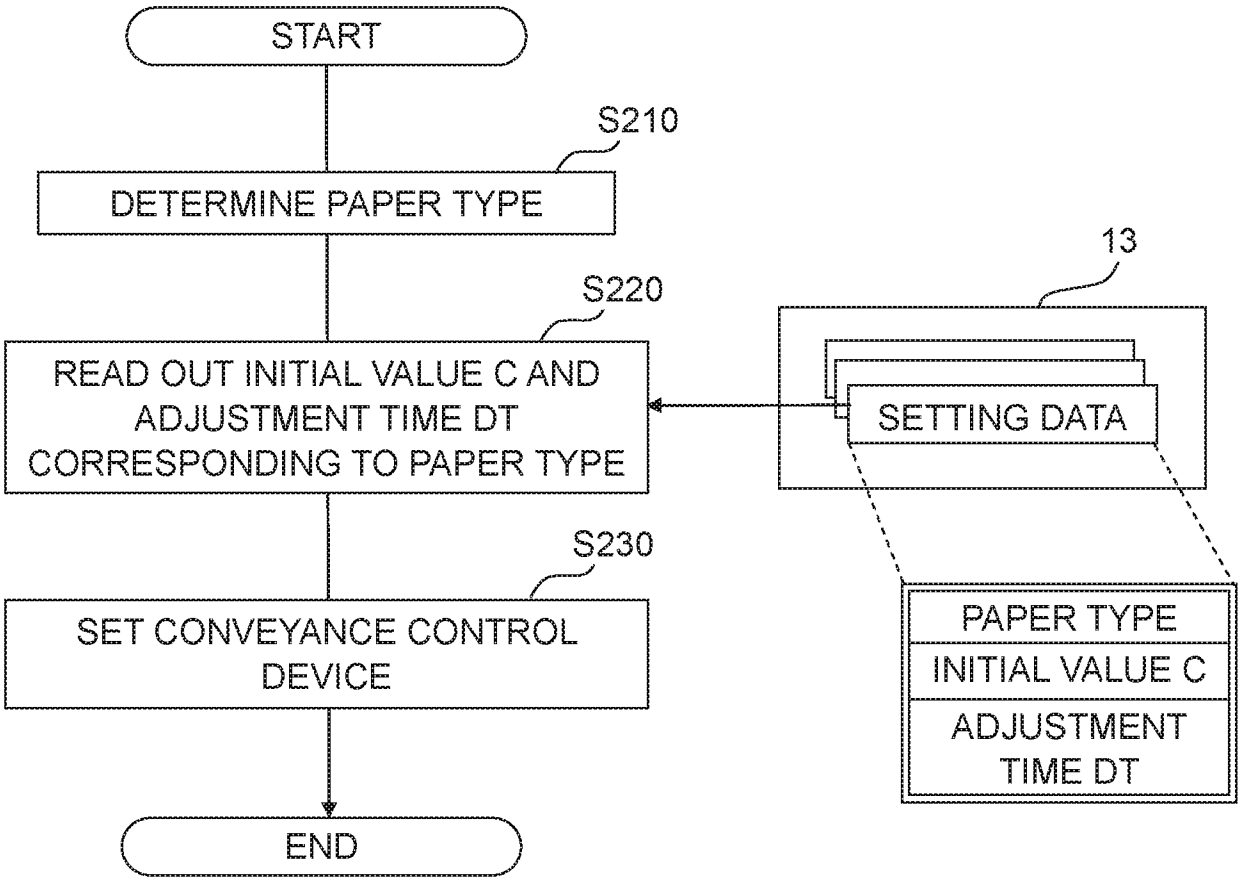
FIG. 9 is a flowchart depicting a process carried out by a main controller.

On starting the process depicted in FIG. 9, the main controller 10 determines the type of the paper Q supplied to the first roller 110 from the received paper type information (S210). Then, it reads out from the ROM 13 the initial value C and the adjustment time DT corresponding to the determined type of the paper Q.

The ROM 13 of the main controller 10 stores setting data defining the initial value C and the adjustment time DT according to each paper type. The main controller 10 can read out from the ROM 13 the initial value C and the adjustment time DT of the setting data corresponding to the determined paper type.

Thereafter, the main controller 10 sets the conveyance controller 60 with the initial value C and the adjustment time DT read out in the above, and causes the conveyance controller 60 to carry out the conveyance control process depicted in FIG. 3 (S230). By virtue of this, the main controller 10 can cause the conveyance controller 60 to adjust the gain K1 in the step 5130 for each control period, according to the initial value C and the adjustment time DT corresponding to the type of the paper Q.

According to the first modification, for each paper type, it is possible to provide the image forming system 1 of high performance capable of switching the initial value C and the adjustment time DT, so as to maximally improve the quality of the image formed on the paper. It is possible to find through experiment the optimum combination of the initial value C and the adjustment time DT for each paper type. For example, it is possible to set the adjustment time DT to let down the reductive speed of the gain K1 for the type of harder paper.

[Second Modification]

Figure 10:
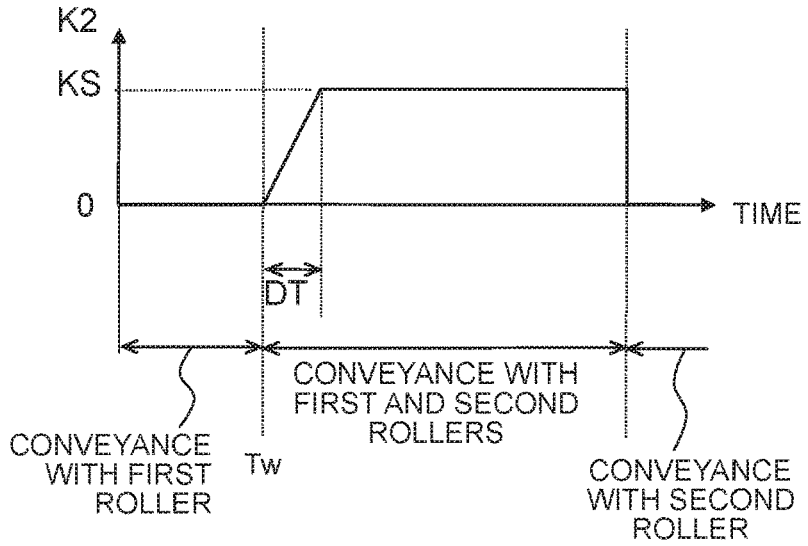
FIG. 10 is a graph depicting a gain adjustment aspect according to a modification.

The image forming system 1 according to a second modification is configured to adjust the gain K2 of a proportional module 313A of a tension control module 313, instead of the gain K1. As depicted in FIG. 10, the conveyance controller 60 sets the gain K2 to zero at the switch point Tw, and then carries out the step S130 to monotonously increase the gain K2 from the value 0 to the standard value KS over the time DT.

On this occasion, the conveyance controller 60 can operate to maintain the gain K1 of the reference control input entry module 315 at the value 1 from the switch point Tw. The conveyance controller 60 operates to maintain the gain K2 at the standard value KS after the gain K2 reaches the standard value KS.

If the gain K2 is set smaller than the standard value KS in the initial period of carrying out the speed/tension control, then because the tension control input UT decreases, as a result, the control input U11 is restrained from decreasing. Therefore, even if the gain K2 is adjusted as depicted in FIG. 10, the same effect is still attainable as in the aforementioned embodiment.

[Third Modification]

Figure 11:
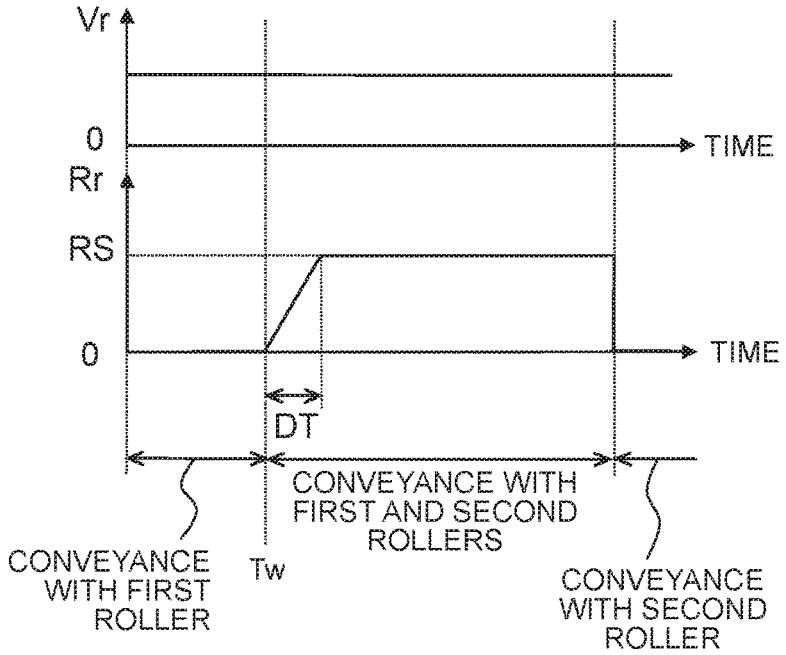
FIG. 11 is a graph depicting an adjustment aspect of the target tension according to another modification.

The image forming system 1 according to a third modification is configured to adjust the target tension Rr instead of the gain Kl. As depicted in FIG. 11, the conveyance controller 60 sets the target tension Rr outputted from the tension command module 310 to zero at the switch point Tw, and then carries out the step S130 to monotonously increase the standard value RS from the value 0 to the standard value RS over the time DT.

On this occasion, the conveyance controller 60 can operate to maintain the gain K1 of the reference control input entry module 315 at the value 1 from the switch point Tw. The conveyance controller 60 operates to maintain the target tension Rr at the standard value RS after the target tension Rr reaches the standard value RS.

If the target tension Rr is set smaller than the standard value RS in the initial period of carrying out the speed/tension control, then because the tension deviation Re decreases, the tension control input UT becomes smaller and, as a result, the control input U11 is restrained from decreasing. Therefore, even if the target tension Rr is adjusted as depicted in FIG. 11, the same effect is still attainable as in the aforementioned embodiment.

[Fourth Modification]

Figure 12:
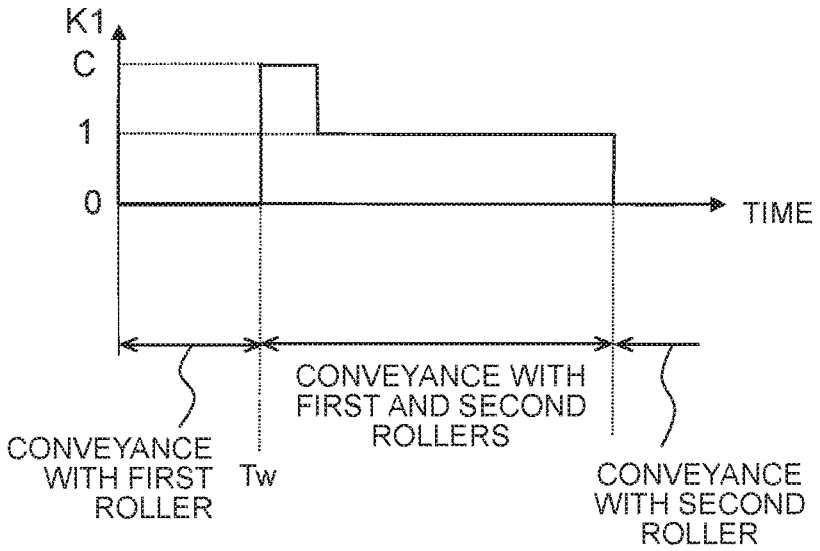
FIG. 12 is a graph depicting a gain adjustment aspect according to still a modification.

The image forming system 1 according to a fourth modification is configured to adjust the gain K1 as depicted in FIG. 12. That is, the conveyance controller 60 sets the gain K1 to the initial value C at the switch point Tw and, if the deviation Re changes to less than a threshold value, then carries out the step S130 to change the gain K1 to the standard value K1=1.

Figure 13:
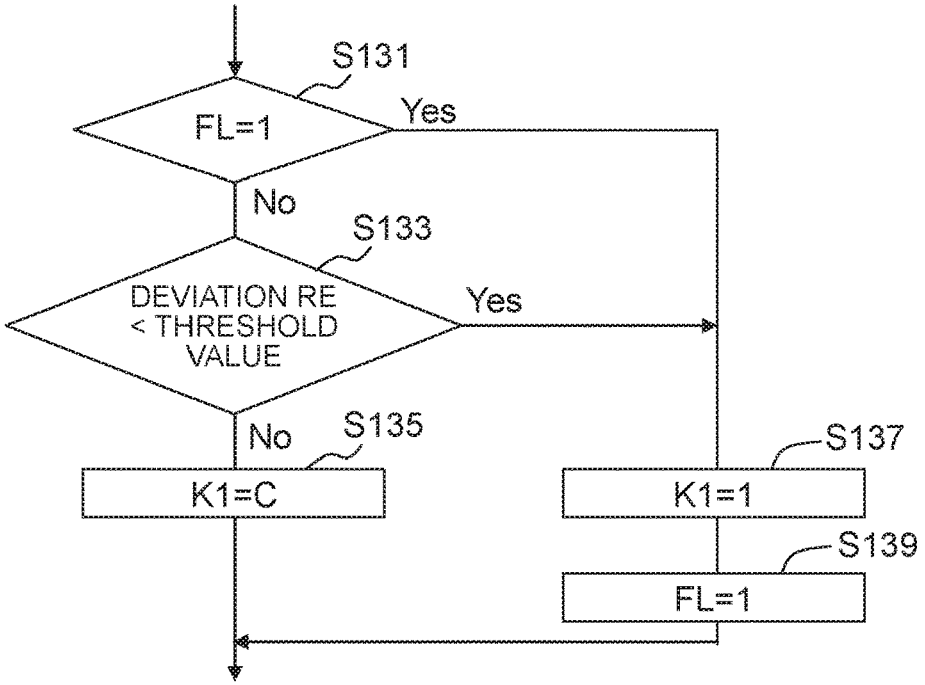
FIG. 13 is a flowchart concerning a gain adjustment according to still another modification.

For example, in the step S130, the conveyance controller 60 can carry out a process depicted in FIG. 13. A flag FL depicted in FIG. 13 is reset to the value zero at the time of starting the conveyance control process (see FIG. 3). The conveyance controller 60 can carry out the process depicted in FIG. 13 for each control period.

In the step S131, the conveyance controller 60 determines whether or not the flag FL is set at the value 1. If the flag FL is set at the value 1 (S131: Yes), then the process proceeds to the step S137, whereas if the flag FL is the value 0 (S131: No), then the process proceeds to the step S133.

In the step S133, the conveyance controller 60 determines whether or not the deviation Re calculated by the tension deviation calculation module 312 is less than the predetermined threshold value. If the deviation Re is not less than the threshold value (S133: No), then the conveyance controller 60 sets the gain K1 to the initial value C larger than 1 (S135). If the deviation Re is less than the threshold value (S133: Yes), then the process proceeds to the step S137.

In the step S137, the conveyance controller 60 sets the gain K1 to the value 1 and, furthermore, sets the flag FL to the value 1, too (S139).

According to the fourth modification, the same effect is attainable as in the aforementioned embodiment. Especially, because the gain K1 is set to the standard value 1 under the condition of the tension of the paper Q being close to the target tension Rr, it is possible to set the gain K1 to the standard value 1 at an appropriate time for the situation.

[Fifth Modification]

It is possible to realize the restraint of the control input U11 from change in the initial period of carrying out the speed/tension control by a method without adjusting the gain K1 or K2 or adjusting the target tension Rr. The image forming system 1 according to a fifth modification is configured to carry out the speed/tension control according to such a controller that the tension control module 313 (see FIG. 5) in the controller 300 is replaced by a tension control module 500 depicted in FIG. 14.

Figure 14:
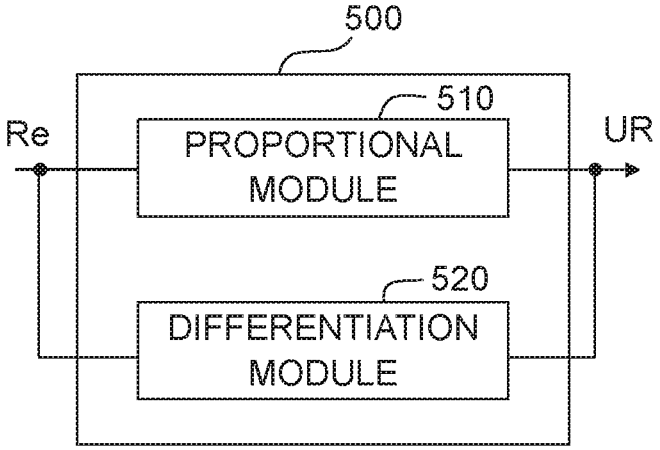
FIG. 14 is a block diagram depicting a configuration of a tension control module according to still another modification.

As depicted in FIG. 14, the tension control module 500 includes a proportional module 510 and a differentiation module 520 to function as a proportional derivative control module. The tension control module 500 may be configured with, in particular, a transfer function including a proportional element and a derivative element. The tension control module 500 outputs, as the tension control input UR, an additional value Up+Ud of an output Up of the proportional module 510 based on the deviation Re from the tension deviation calculation module 312, and an output Ud of the differentiation module 520 based on the deviation Re. The gain of the differentiation module 520 is determined to reduce the output Up of the proportional module 510 by the output Ud of the differentiation module 520, immediately after the switch point Tw.

In the fifth modification, the gain K1 is maintained at the value 1. According to the fifth modification, too, with the effect of the differentiation module 520, it is possible to restrain the control input U11 from change immediately after the switch point Tw of control, thereby being able to obtain the same effect as in the aforementioned embodiment.

Hereinabove, the explanations were made on an exemplary embodiment, including modifications, of the present disclosure. However, the present disclosure is not limited to the above embodiment but can take on various aspects. For example, the present disclosure may also be applied to other systems than image forming systems.

The function of one component in the above embodiment including the modifications may be provided by a plurality of dispersed components. The function of a plurality of components may be integrated into one component. Part of the configuration of the above embodiment may be omitted. At least a part of the configuration of the above embodiment may be added to or replaced by another part of the above configuration. Embodiment of the present disclosure is each and every aspect included in the technological thought identified from the language stated in the appended claims.

[Correspondence Relations]

Finally, correspondence relations between the words and/or terms used above will be explained. The first motor 73 corresponds to an example of the first drive device. The second motor 83 corresponds to an example of the second drive device. The first encoder 75 and the first signal processing circuit 77 correspond to an example of the first measuring device. The second encoder 85 and the second signal processing circuit 87 correspond to an example of the second measuring device. The conveyance controller 60 and the main controller 10 correspond to an example of the controller.

What is claimed is:

1. A conveyance system configured to convey a sheet, comprising:

a conveyance mechanism including a first roller and a second roller arranged apart from the first roller in a conveyance path for the sheet, the conveyance mechanism being configured to convey the sheet by the first roller and the second roller;

a first driver configured to drive the first roller;

a second driver configured to drive the second roller;

a first measuring device configured to measure a state quantity related to a rotation of the first roller;

a second measuring device configured to measure a state quantity related to a rotation of the second roller; and a controller configured to control the first driver by inputting a drive signal corresponding to a first control input U1 to the first driver, and control the second driver by inputting a drive signal corresponding to a second control input U2 to the second driver, wherein in a first period during which the sheet is conveyed with one of the first roller and the second roller, the controller is configured to perform:

calculating the first control input U1 based on the state quantity measured by the first measuring device, and a target state quantity; and calculating the second control input U2 based on the state quantity measured by the second measuring device, and the target state quantity, wherein in a second period during which the sheet is conveyed with both of the first roller and the second roller, the controller is configured to perform:

calculating the second control input U2 based on the state quantity measured by the second measuring device, and the target state quantity;

calculating a first estimated tension value R1 which is an estimated value of a tension exerted on the first roller, based on the first control input U1 and the state quantity measured by the first measuring device;

calculating a second estimated tension value R2 which is an estimated value of a tension exerted on the second roller, based on the second control input U2 and the state quantity measured by the second measuring device;

calculating a tension control input UR which is a control input for controlling a tension of the sheet based on the first estimated tension value R1, the second estimated tension value R2, and a target tension Rr;

calculating the first control input U1=U2−UR for conveying the sheet with the target tension by subtracting the tension control input UR from the second control input U2; and wherein in an initial period of the second period, the controller is configured to perform adjusting the first control input U1 to restrain the first control input U1 from change.

2. The conveyance system according to claim 1, wherein in the second period, the controller is configured to perform calculating the first control input U1 subjected to the formula U1=K1×U2−UR, based on a gain K1, the second control input U2 and the tension control input UR, and wherein in the initial period of the second period, the controller is configured to perform decreasing the gain K1 as an adjustment parameter from an initial value larger than the value 1 to the value 1, and thereby adjusting the first control input U1 to restrain the first control input U1 from change.

3. The conveyance system according to claim 2, wherein the controller is configured to perform adjusting a value of the adjustment parameter to change a speed according to a type of the sheet.

4. The conveyance system according to claim 2, wherein the controller is configured to perform setting a value according to a type of the sheet as the initial value.

5. The conveyance system according to claim 1, wherein in the second period, the controller is configured to perform calculating the tension control input UR subjected to a formula UR=K2×{Rr−(R2−R1)/2}, based on a gain K2, the first estimated tension value R1, the second estimated tension value R2 and the target tension Rr, and wherein in the initial period of the second period, the controller is configured to perform increasing the gain K2 as an adjustment parameter from an initial value to a standard value, and thereby adjusting the first control input U1 to restrain the first control input U1 from change.

6. The conveyance system according to claim 1, wherein in the initial period of the second period, the controller is configured to perform increasing the target tension Rr as an adjustment parameter from an initial value to a standard value, and thereby adjusting the first control input U1 to restrain the first control input U1 from change.

7. The conveyance system according to claim 1, wherein in the second period, the controller is configured to perform calculating the first control input U1 subjected to the formula U1=K1×U2−UR, wherein at the beginning of the second period, the controller is configured to perform setting the gain K1 to an initial value larger than the value 1, and wherein in the initial period of the second period, the controller is configured to perform setting the gain K1 to the value 1 under the condition that a deviation (Rr−RP) becomes less than a reference value, and thereby adjusting the first control input U1 to restrain the first control input U1 from change, wherein RP is an estimated tension of the sheet and is subjected to a formula RP=(R2−R1)/2.

8. The conveyance system according to claim 1, wherein the state quantity is a speed, and the target state quantity is a target speed.

9. A conveyance system configured to convey a sheet, comprising:

a conveyance mechanism including a first roller and a second roller arranged apart from the first roller in a conveyance path for the sheet, the conveyance mechanism being configured to convey the sheet by rotations of the first roller and the second roller;

a first driver configured to drive the first roller;

a second driver configured to drive the second roller;

a first measuring device configured to measure a state quantity related to a rotation of the first roller;

a second measuring device configured to measure a state quantity related to a rotation of the second roller; and a controller configured to control the first driver by inputting a drive signal corresponding to a first control input U1 to the first driver and control the second driver by inputting a drive signal corresponding to a second control input U2 to the second driver, wherein in a first period during which the sheet is conveyed with one of the first roller and the second roller, the controller is configured to perform:

calculating the first control input U1 based on the state quantity measured by the first measuring device, and a target state quantity, and calculating the second control input U2 based on the state quantity measured by the second measuring device, and the target state quantity;

wherein in a second period during which the sheet is conveyed with both of the first roller and the second roller, the controller is configured to perform:

calculating the second control input U2 based on the state quantity measured by the second measuring device, and the target state quantity;

calculating a first estimated tension value R1 which is an estimated value of a tension exerted on the first roller, based on the first control input U1 and the state quantity measured by the first measuring device;

calculating a second estimated tension value R2 which is an estimated value of a tension exerted on the second roller, based on the second control input U2 and the state quantity measured by the second measuring device;

calculating, with a function, a tension control input UR which is a control input for controlling a tension of the sheet based on the first estimated tension value R1, the second estimated tension value R2, and a target tension Rr; and calculating the first control input U1=U2−UR for conveying the sheet with the target tension by subtracting the tension control input UR from the second control input U2, and wherein the function includes a derivative element for restraining the tension control input UR from change in an initial period of the second period.

10. The conveyance system according to claim 9, wherein in the second period, the controller is configured to perform calculating the tension control input UR by inputting a deviation (Rr−RP) to a proportional derivative control module, and thereby adjusting the tension control input UR to restrain the tension control input UR from change in the initial period of the second period, wherein RP is an estimated tension of the sheet and is subjected to a formula RP=(R2−R1)/2.

11. The conveyance system according to claim 9, wherein the state quantity and the target state quantity are, respectively, a speed and a target speed.

* * * * *